US007431745B2

(12) United States Patent
Krull et al.

(10) Patent No.: US 7,431,745 B2
(45) Date of Patent: Oct. 7, 2008

(54) ADDITIVES WITH A REDUCED TENDENCY TO EMULSIFY, WHICH IMPROVE THE LUBRICATING ACTION OF HIGHLY DESULPHURISED FUEL OILS

(75) Inventors: Matthias Krull, Harxheim (DE); Markus Kupetz, Dinslaken (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 648 days.

(21) Appl. No.: 10/484,971

(22) PCT Filed: Jul. 9, 2002

(86) PCT No.: PCT/EP02/07616

§ 371 (c)(1),
(2), (4) Date: Jul. 22, 2004

(87) PCT Pub. No.: WO03/012015

PCT Pub. Date: Feb. 13, 2003

(65) Prior Publication Data

US 2006/0254128 A1 Nov. 16, 2006

(30) Foreign Application Priority Data

Jul. 27, 2001 (DE) ..... 101 36 828

(51) Int. Cl.
*C10L 1/18* (2006.01)

(52) U.S. Cl. ..... 44/388; 44/389; 44/393; 44/395; 44/398; 44/450

(58) Field of Classification Search ..... 44/388, 44/389, 393, 395, 398, 450
See application file for complete search history.

(56) References Cited

U.S. PATENT DOCUMENTS

| | | | | |
|---|---|---|---|---|
| 2,063,856 | A | | 12/1936 | Rosenblum |
| 4,211,534 | A | | 7/1980 | Feldman |
| 4,670,516 | A | | 6/1987 | Sackmann et al. |
| 4,713,088 | A | | 12/1987 | Tack et al. |
| 4,985,048 | A | | 1/1991 | Wirtz et al. |
| 5,186,720 | A | | 2/1993 | Feustel et al. |
| 5,391,632 | A | | 2/1995 | Feustel et al. |
| 5,468,405 | A | | 11/1995 | Klein et al. |
| 5,833,722 | A | | 11/1998 | Davies |
| 5,858,028 | A | | 1/1999 | Davies |
| 5,882,364 | A | | 3/1999 | Dilworth |
| 5,958,089 | A | | 9/1999 | Dillworth |
| 5,993,498 | A | * | 11/1999 | Vrahopoulou et al. ..... 44/388 |
| 5,998,530 | A | * | 12/1999 | Krull et al. ..... 524/474 |
| 6,090,169 | A | * | 7/2000 | Krull et al. ..... 44/395 |
| 6,461,393 | B1 | | 10/2002 | Krull et al. |
| 6,475,250 | B2 | | 11/2002 | Krull et al. |
| 6,592,638 | B2 | | 7/2003 | Krull et al. |
| 6,652,610 | B2 | | 11/2003 | Krull et al. |
| 6,793,695 | B2 | * | 9/2004 | Wilkes et al. ..... 44/385 |

FOREIGN PATENT DOCUMENTS

| | | |
|---|---|---|
| EP | 0680506 | 11/1995 |
| WO | WO 96/18708 | 6/1996 |
| WO | WO 95/03377 | 7/1996 |
| WO | WO 97/38965 | 10/1997 |

OTHER PUBLICATIONS

Abstract WO 97/38965, Oct. 23, 1997.
D. Wei and H. Spikes, "The Lubricity of Diesel Fuels", (1986), p. 217-235, Wear, vol. III, No. 2, Elsevier.
Falbe et al., Roempp Chemie Lexikon, "Fats and Oils" pp. 1320-1322 91997).
N.A. Plate et al., "Comb-Like Polymers-Structure and Properties", J. Poly Sci, Macromolecular Revs, pp. 117-253(1974).

* cited by examiner

*Primary Examiner*—Cephia D Toomer
(74) *Attorney, Agent, or Firm*—Richard P. Silverman

(57) ABSTRACT

The present invention relates to an additive for improving the lubrication capacity of fuel oils with a maximum sulfur content of 0.035 wt. %. The additive contains at least one ester of a bivalent or polyvalent alcohol and a mixture of unsaturated and optionally saturated fatty acids, whose carbon chain lengths are between 8 and 30 carbon atoms, the aforementioned esters having an OH value of less than 200 mg KOH/g ester and an iodine value greater than 100 g l/100 g ester. The invention also relates to fuel oils with a maximum sulfur content of 0.035 wt. %, which contain the inventive additives. The novel additives exhibit less tendency to emulsify than the additives of the prior art.

16 Claims, No Drawings

ADDITIVES WITH A REDUCED TENDENCY TO EMULSIFY, WHICH IMPROVE THE LUBRICATING ACTION OF HIGHLY DESULPHURISED FUEL OILS

Additives with a reduced tendency to emulsify, which improve the lubricating action of highly desulfurized fuel oils.

The present invention relates to additives composed of esters between polyols and fatty acid mixtures, and also to their use for improving the lubricity of highly desulfurized fuel oils coupled with simultaneously reduced tendency to emulsify.

Mineral oils and mineral oil distillates which are used as fuel oils generally contain 0.5% by weight or more of sulfur, which causes the formation of sulfur dioxide in the course of combustion. In order to reduce the resulting environmental pollution, the sulfur content of fuel oils is being reduced ever further. The standard EN 590 relating to diesel fuels currently prescribes a maximum sulfur content of 350 ppm in Germany. In Scandinavia, fuel oils having fewer than 50 ppm, and in exceptional cases having fewer than 10 ppm, of sulfur are already being used. These fuel oils are generally produced by refining, under hydrogenating conditions, the fractions obtained from crude oil by distillation. However, the desulfurization also removes other substances which confer a natural lubricity on the fuel oils. Among others, these substances include polyaromatic and polar compounds.

It has now been found that the friction- and wear-reducing properties of fuel oils deteriorate with an increasing degree of desulfurization. These properties are often so inadequate that instances of corrosion are to be expected even after a short time on the materials lubricated by the fuel, for example the distributor injection pumps of diesel engines. The maximum value for the 95% distillation point of 360° C. laid down by EN 590 since the year 2000 and the further reduction of the 95% distillation point to below 350° C. and sometimes below 330° C. which has been undertaken in the meantime in Scandinavia aggravates these problems further.

The prior art therefore describes approaches which are intended to provide a solution to this problem (lubricity additives).

EP-A-0 680 506 discloses that esters of fatty acids confer improved lubricity to highly desulfurized fuel oils. Particular mention is made of glycerol monooleate and diisodecyl adipate.

EP-A-0 739 970 discloses the suitability of fatty acid mixtures for improving the lubricity of low-sulfur fuel oils. Compositions having different degrees of esterification and different degrees of saturation of the fatty acids are disclosed.

EP-A-0 839 174 discloses fuel oils with improved lubricity which are low in sulfur and comprise a mixture of polyol esters with unsaturated fatty acids.

However, the fatty acid esters based on commercial fatty acid mixtures of the prior art show a marked tendency to emulsify in the fuel oils additized by them. This means that emulsification of the water in the fuel oil takes place on contact of such a fuel oil with water. These emulsions to be found in particular on the oil/water phase boundary can only be removed with great difficulty, if at all. Since these emulsions as such cannot be used directly as fuel oils, they reduce the value of the products. This problem occurs to a particularly high degree when esters based on natural fatty acid mixtures are used.

It is an object of the present invention to find lubricity-improving additives for desulfurized fuel oils which have a reduced tendency to emulsify compared to the prior art.

It has been found that, surprisingly, esters of fatty acid mixtures which have a certain combination of hydroxyl number and iodine number do not have the emulsifiability of the esters of the prior art, and have excellent lubricity in desulfurized fuel oils. It is presumed that the reduced tendency to emulsify is brought about by two effects: firstly, the polarity range of the additives, which is determined by the OH number, brings about a reduced affinity of the amphiphilic active ingredients for water. Secondly, the formation of micellar, surface-active structures is simultaneously disrupted by the number of double bonds in the alkyl radicals, which is defined by means of the iodine number.

The present invention therefore provides an additive for improving the lubricity of fuel oils having a maximum sulfur content of 0.035% by weight, comprising at least one ester of a di- or polyhydric alcohol and a mixture of unsaturated and optionally saturated fatty acids whose carbon chain lengths are between 8 and 30 carbon atoms, the esters mentioned having an OH number of below 200 mg KOH/g of ester and an iodine number of more than 100 g of I/100 g of ester.

The invention further provides fuel oils having a maximum sulfur content of 0.035% by weight which comprise the additives according to the invention.

The invention further provides the use of the additives according to the invention for improving the lubricity of fuel oils having a sulfur content of at most 0.035% by weight.

The invention further provides a process for improving the lubricity of fuel oils having a maximum sulfur content of 0.035% by weight, by adding the additive according to the invention to the fuel oils.

Preferred fatty acids which are a constituent of the fatty acid mixture are those having from 10 to 26 carbon atoms, in particular from 12 to 22 carbon atoms. The alkyl radicals of the fatty acids consist substantially of carbon and hydrogen. However, they may also contain as further constituents, for example, hydroxyl, halogen, amino or nitro groups, as long as they do not impair the predominant hydrocarbon character. The fatty acids present in the fatty acid mixture preferably contain at least one double bond. They may contain a plurality of double bonds, for example two or three double bonds, and be of natural or synthetic origin. In the case of polyunsaturated carboxylic acids, their double bonds may be isolated or else conjugated. In preferred fatty acid mixtures, at least 50% by weight, in particular at least 75% by weight, especially at least 90% by weight, of the fatty acids contain one or more double bonds. The iodine numbers of the parent fatty acids of the esters according to the invention are preferably between 105 and 190 g, in particular from 110 to 180 g and especially from 120 to 180 g, of I/100 g of ester.

Suitable fatty acid mixtures contain at least two unsaturated fatty acids having from 10 to 26 carbon atoms. Suitable unsaturated fatty acids are, for example, oleic acid, erucic acid, palmitoleic acid, myristoleic acid, linoleic acid, linolenic acid, elaeosteric acid, arachidonic acid and/or ricinoleic acid. Preference is given in accordance with the invention to using fatty acid mixtures or fractions obtained from natural fats and oils, for example peanut oil fatty acid, fish oil fatty acid, linseed oil fatty acid, palm oil fatty acid, rapeseed oil fatty acid, ricenic oil fatty acid, castor oil fatty acid, colza oil fatty acid, soya oil fatty acid, sunflower oil fatty acid and tall oil fatty acid, each of which have appropriate iodine numbers.

In addition, the fatty acid mixtures may contain minor amounts, i.e. up to 10% by weight, preferably less than 5% by weight, especially less than 2% by weight, of saturated fatty acids, for example lauric acid, tridecanoic acid, myristic acid, pentadecanoic acid, palmitic acid, margaric acid, stearic acid, isostearic acid, arachic acid and behenic acid.

Likewise suitable as a constituent of the fatty acid mixtures are dicarboxylic acids such as dimerized fatty acids and alkyl- and alkenylsuccinic acids having $C_8$-$C_{50}$-alk(en)yl radicals, preferably having $C_8$-$C_{40}$-alkyl radicals, in particular having $C_{12}$-$C_{22}$-alkyl radicals. The alkyl radicals may be either linear or branched (oligomerized alkenes, PIB). Preference is given to proportions of up to 10% by weight, in particular less than 5% by weight. The fatty acids may also contain 1-40% by weight, especially 1-25% by weight, in particular 1-5% by weight, of resin acids.

Suitable alcohols contain preferably from 2 to 6, in particular from 3 to 4, carbon atoms, and from 2 to 5, in particular from 3 to 4, hydroxyl groups, but a maximum of one hydroxyl group per carbon atom. Particularly suitable alcohols are ethylene glycol, diethylene glycol, propylene glycol, glycerol and pentaerythritol.

The esters can be prepared from alcohols and fatty acids in a known manner by esterification. As an alternative, it is also possible to partially hydrolyze naturally occurring fats and oils. Esters according to the invention are those which can be prepared from a di- or polyhydric alcohol and a mixture of fatty acids. These include both mixtures, for example, of monoesters of an alcohol with different fatty acids, of monoesters of different alcohols with different fatty acids, and mixtures of mono-, di- and/or triesters, or optionally higher esters, of one or more alcohols with different fatty acids. Esters are in accordance with the invention when they can be prepared from a fatty acid mixture.

The iodine numbers of the esters according to the invention are preferably between 100 and 180 g, in particular from 110 to 150 g, of I/100 g of ester. The iodine numbers result from the iodine number of the parent fatty acid mixture and the alcohol used for the esterification in a stoichiometric manner.

The OH number of the esters in the additive according to the invention is preferably between 110 and 195, in particular between 130 and 190 mg KOH/g of ester. In general, these are mixtures of different esters, for example mixtures of mono-, di- and triglycerides, mixtures as occur in the esterification of polyols.

The additives according to the invention are added to oils in amounts of from 0.001 to 0.5% by weight, preferably from 0.005 to 0.3% by weight and especially from 0.01 to 0.1% by weight. They may be used as such or else dissolved in solvents, for example aliphatic and/or aromatic hydrocarbons or hydrocarbon mixtures, for example toluene, xylene, ethylbenzene, decane, pentadecane, benzine fractions, kerosene or commercial solvent mixtures, such as Solvent Naphtha, ®Shellsol AB, ®Solvesso 150, ®Solvesso 200, and ®Exxsol, ®Isopar and ®Shellsol D types. The additives according to the invention preferably contain 1-80%, especially 10-70%, in particular 25-60%, of solvent. The additives, which may be used without difficulty even at low temperatures of, for example, −30° C. and lower, improve the lubricity of the additized oils with simultaneously reduced tendency to emulsify.

To prepare additive packages for specific solutions to problems, the additives according to the invention may also be used together with one or more oil-soluble coadditives which in themselves improve the lubricity and/or cold-flow properties of crude oils, lubricant oils or fuel oils. Examples of such coadditives are vinyl acetate-containing copolymers or terpolymers of ethylene, paraffin dispersants, comb polymers, alkylphenol-aldehyde resins and also oil-soluble amphiphiles.

For instance, mixtures of the additives according to the invention with copolymers which contain from 10 to 40% by weight of vinyl acetate and from 60 to 90% by weight of ethylene have been found to be outstandingly useful. In a further embodiment of the invention, the additives according to the invention are used in a mixture with ethylene/vinyl acetate/vinyl neononanoate terpolymers or ethylene/vinyl acetate/vinyl neodecanoate terpolymers to simultaneously improve the flowability and lubricity of mineral oils or mineral oil distillates. Apart from ethylene, the terpolymers of vinyl neononanoate or vinyl neodecanoate contain from 10 to 35% by weight of vinyl acetate and from 1 to 25% by weight of the particular neo compound. In addition to ethylene and from 10 to 35% by weight of vinyl esters, further preferred copolymers also contain from 0.5 to 20% by weight of olefin such as diisobutylene, 4-methylpentene or norbornene. The mixing ratio of the additives according to the invention with the above-described ethylene/vinyl acetate copolymers or the terpolymers of ethylene, vinyl acetate and of vinyl esters of neononanoic acid or of neodecanoic acid (in parts by weight) is from 20:1 to 1:20, preferably from 10:1 to 1:10.

For use as a flow improver and/or lubricity additive, the reaction products according to the invention may also be used together with paraffin dispersants. Paraffin dispersants reduce the size of the paraffin crystals and have the effect that the paraffin particles do not settle, but rather remain dispersed colloidally with a distinctly reduced tendency to sedimentation. In addition, they reinforce the lubricity of the additives according to the invention. Useful paraffin dispersants have been found to be oil-soluble polar compounds having ionic or polar groups, for example amine salts and/or amides, which are obtained by reacting aliphatic or aromatic amines, preferably long-chain aliphatic amines, with aliphatic or aromatic mono-, di-, tri- or tetracarboxylic acids or their anhydrides (cf. U.S. Pat. No. 4,211,534). Other paraffin dispersants are copolymers of maleic anhydride and α,β-unsaturated compounds which may optionally be reacted with primary monoalkylamines and/or aliphatic alcohols (cf. EP 0 154 177), the reaction products of alkenyl-spiro-bislactones with amines (cf. EP 0 413 279 B1) and, according to EP 0 606 055 A2, reaction products of terpolymers based on α,β-unsaturated dicarboxylic anhydrides, α,β-unsaturated compounds and polyoxyalkylene ethers of lower unsaturated alcohols. Alkylphenol-aldehyde resins are also suitable as paraffin dispersants.

For instance, the additives according to the invention may be used in a mixture with alkylphenol-formaldehyde resins. In a preferred embodiment of the invention, these alkylphenol-formaldehyde resins are those of the formula

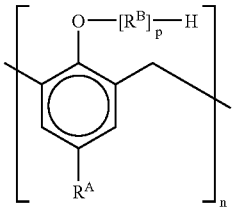

where $R^A$ is $C_4$-$C_{50}$-alkyl or alkenyl, $R^B$ is ethoxy and/or propoxy, n is a number from 5 to 100 and p is a number from 0 to 50.

Finally, in a further embodiment of the invention, the additives according to the invention are used together with comb polymers. This refers to polymers in which hydrocarbon radicals having at least 8, in particular at least 10, carbon atoms are bonded to a polymer backbone. These are preferably homopolymers whose alkyl side chains have at least 8 and in particular at least 10 carbon atoms. In copolymers, at least 20%, preferably at least 30%, of the monomers have side chains (cf. Comb-like Polymers-Structure and Properties; N. A. Platé and V. P. Shibaev, J. Polym. Sci. Macromolecular Revs. 1974, 8, 117 ff). Examples of suitable comb polymers are, for example, fumarate/vinyl acetate copolymers (cf. EP 0 153 176 A1), copolymers of a $C_6$-$C_{24}$-α-olefin and an N-$C_6$-$C_{22}$-alkylmaleimide (cf. EP 0 320 766), and also esterified olefin/maleic anhydride copolymers, polymers and copolymers of α-olefins and esterified copolymers of styrene and maleic anhydride.

Comb polymers can be described, for example, by the formula

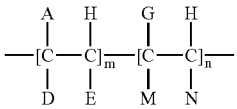

In this formula:

A is R', COOR', OCOR', R"—COOR' or OR';

D is H, $CH_3$, A or R;

E is H or A;

G is H, R", R"—COOR', an aryl radical or a heterocyclic radical;

M is H, COOR", OCOR", OR" or COOH;

N is H, R", COOR", OCOR, COOH or an aryl radical;

R' is a hydrocarbon chain having 8-150 carbon atoms;

R" is a hydrocarbon chain having from 1 to 10 carbon atoms;

m is a number between 0.4 and 1.0; and n is a number between 0 and 0.6.

The mixing ratio (in parts by weight) of the additives according to the invention with resins or comb polymers is in each case from 1:10 to 20:1, preferably from 1:1 to 10:1.

The additives according to the invention are particularly well suited to use in middle distillates. Middle distillates refer in particular to those mineral-oils which are obtained by distillation of crude oil and boil in the range from 120 to 450° C., for example kerosene, jet fuel, diesel and heating oil. The oils can also contain alcohols such as methanol and/or ethanol or consist of these. The additives according to the invention are preferably used in those middle distillates which contain fewer than 350 ppm of sulfur, in particular fewer than 200 ppm of sulfur and in special cases fewer than 50 ppm of sulfur. These are generally those middle distillates which have been subjected to refining under hydrogenating conditions, and therefore only contain small fractions of polyaromatic and polar compounds which confer a natural lubricity on them. The additives according to the invention are also preferably used in those middle distillates which have 95% distillation points below 370° C., in particular 350° C. and in special cases below 330° C. They can also be used as components in lubricant oils.

The mixtures can be used alone or else together with other additives, for example with pour point depressants or dewaxing assistants, with corrosion inhibitors, antioxidants, sludge inhibitors, dehazers, conductivity improvers, lubricity additives, and additives for reducing the cloud point. They are also used successfully together with additive packages which contain, inter alia, known ashless dispersant additives, detergents, antifoams, and corrosion inhibitors. The synergisms which are described in the prior art are achieved between the additives according to the invention and the further additives mentioned with regard to cold-flow properties in accordance with WO-95/03377 and lubricity in accordance with WO-96/18708 and WO-96/23855.

The effectiveness of the additives according to the invention as lubricity additives is illustrated in detail by the examples which follow.

EXAMPLES

TABLE 1

Characterization of the additives used (inv = inventive, C = comparative)

| Additive | OH number [mg KOH/g] | Iodine number [g l/100 g] | Chemical characterization |
|---|---|---|---|
| A (inv) | 158 | 103 | partial ester of glycerol and soya oil fatty acid |
| B (C) | 181 | 52 | partial ester of glycerol and tallow fatty acid |
| C (C) | 153 | 76 | partial ester of glycerol and olein |
| D (inv) | 88 | 116 | partial ester of glycerol and tall oil fatty acid |
| E (inv) | 193 | 122 | partial ester of glycerol and tall oil fatty acid |
| F (C) | 278 | 77 | partial ester of glycerol and olein |

The OH numbers are determined to DIN 53240 by reacting with a defined excess amount of acetic anhydride and subsequently titrating the acetic acid formed.

Iodine numbers are determined according to Kaufmann. To this end, a sample of known mass is admixed with a defined, excess amount of a methanolic bromine solution, and an amount of bromine which is equivalent to the content of double bonds in the sample is added on to the double bonds. The excess of bromine is back-titrated using sodium thiosulfate.

TABLE 2

Esters according to the prior art (comparative values)

| Ester | OH number [mg KOH/g] | Iodine number [g l/100 g] |
|---|---|---|
| Glycerol monooleate (pure) | 315 | 71 |
| Glycerol dioleate (pure) | 90 | 82 |
| EP 0 839 174, Ex. A | 181 | 78 |
| EP 0 839 174, Ex. B | 315 | 71 |
| EP 0 839 174, Ex. C | 317 | 143 |
| EP 0 739 970, Ex. A | 181 | 77 |
| EP 0 739 970, Ex. G | 284 | 120 |
| EP 0 739 970, Ex. H | 141 | 44 |
| EP 0 739 970, Ex. I | 155 | 72 |
| EP 0 739 970, Ex. J | 111 | 74 |
| EP 0 739 970, Ex. K | 185 | 78 |
| EP 0 739 970, Ex. L | 122 | 81 |
| EP 0 739 970, Ex. M | 192 | 77 |
| EP 0 739 970, Ex. N | 8 | 86 |
| EP 0 739 970, Ex. O | 84 | 75 |
| EP 0 739 970, Ex. P | 227 | 76 |
| EP 0 739 970, Ex. Q | 184 | 73 |
| EP 0 739 970, Ex. R | 192 | 62 |

Tendency to emulsify in middle distillates

The tendency of additives to emulsify is tested to ASTM D 1094-85. 80 ml of a diesel fuel are admixed in a 100 ml measuring cylinder with 250 ppm of the additive to be tested, and heated at 60° C. and agitated for 15 minutes. After cooling to room temperature, 2 ml of buffer solution are added and the mixture is agitated for 2 minutes. After 5 minutes, the sample is assessed visually by the following criteria:

| Assessment of the separation layer | | Assessment of the phase separation | |
|---|---|---|---|
| 1 | clear and clean | 1 | complete absence of any emulsions and/or deposits in both phases or on the top of the oil phase. |
| 1b | small, clear bubbles which are estimated to cover not more than 50% of the separation layer. No streaks, no film formation or other wetting at the separation layer. | 2 | as (1), but additionally small air bubbles or small water droplets in the oil phase. |
| 2 | streaks, film formation or other wetting at the separation layer | 3 | emulsions and/or deposits in both phases or on the top of the oil phase, and/or drops in the water phase or adhering to the wall (excluding the wall above the oil phase). In brackets: amount of the water phase |
| 3 | narrow border or slight foam formation, or both | | |
| 4 | thick border or extensive foam formation, or both | | |

TABLE 3

Tendency of the additives to emulsify

| Example | Additive | Separation layer | Phase separation | Oil phase | Water phase |
|---|---|---|---|---|---|
| 1 | A | 1b | 2 (20 ml $H_2O$) | slightly cloudy | clear |
| 2 (C) | B | 3 | 3 (8 ml $H_2O$) | cloudy | clear |
| 3 (C) | C | 4 | 3 (10 ml $H_2O$) | cloudy | clear |
| 4 | D | 2 | 2 (20 ml $H_2O$) | slightly cloudy | clear |
| 5 | E | 2 | 2 (20 ml $H_2O$) | slightly cloudy | clear |
| 6 (C) | F | 3 | 3 (6 ml $H_2O$) | cloudy | clear |

Lubricity in Middle Distillates

The lubricity of the additives was carried out on additized oils at 60° C. by means of an HFRR instrument from PCS Instruments. The high frequency reciprocating rig test (HFRR) is described in D. Wei, H. Spikes, Wear, Vol. 111, No. 2, p. 217, 1986. The results are quoted as the coefficient of friction and wear scar (WS 1.4). A low coefficient of friction and a low wear scar indicate good lubricity.

The test oil used was a Scandinavian winter diesel having the following characteristics:

| | |
|---|---|
| Boiling range: | 185–320° C. |
| Density: | 0.820 g/cm$^3$ |
| Cloud point: | −29° C. |
| Sulfur content: | 3 ppm |

The boiling parameters are determined to ASTM D-86 and the cloud point is determined to ISO 3015.

TABLE 4

Wear scar in test oil 2

| Example | Additive | Dosage | Wear scar | Friction |
|---|---|---|---|---|
| 7 (C) | none | — | 679 μm | 0.40 |
| 8 (C) | glycerol monooleate (99%) | 100 ppm | 230 μm | 0.13 |
| 9 (C) | glycerol dioleate | 100 ppm | 306 μm | 0.16 |

TABLE 4-continued

Wear scar in test oil 2

| Example | Additive | Dosage | Wear scar | Friction |
|---|---|---|---|---|
| 10 | A | 100 ppm | 210 μm | 0.12 |
| 11 (C) | B | 100 ppm | 263 μm | 0.14 |
| 12 (C) | C | 100 ppm | 284 μm | 0.14 |
| 13 | D | 100 ppm | 206 μm | 0.12 |
| 14 | E | 100 ppm | 301 μm | 0.14 |
| 15 (C) | F | 100 ppm | 291 μm | 0.13 |

The invention claimed is:

1. A fuel oil having a maximum sulfur content of 0.035% by weight, comprising an additive comprising at least one ester of a di- or polyhydric alcohol and a mixture comprising unsaturated fatty acids having carbon chain lengths between 8 and 30 carbon atoms, said unsaturated fatty acids selected from the group consisting of oleic acid, erucic acid, palmitoleic acid, myristoleic acid, linoleic acid, linolenic acid, elaeosteric acid, arachidonic acid, ricinoleic acid and mixtures thereof, the at least one ester having an OH number of between 110 and 195 mg KOH/g of ester and an iodine number of more than 100 g of I/100 g of ester, in amounts of from 0.001 to 0.5% by weight based on the fuel oil.

2. A fuel oil as claimed in claim 1, wherein the iodine number is between 100 and 180 g of I/100 g of ester.

3. The fuel oil of claim 1, wherein said unsaturated fatty acids have from 10 to 26 carbon atoms.

4. The fuel oil of claim 1, wherein the mixture comprising said unsaturated fatty acids further comprises less than 10% by weight of saturated fatty acids.

5. The fuel oil of claim 1, wherein the di- or polyhydric alcohol contains from 2 to 6 carbon atoms.

6. The fuel oil of claim 1, wherein the di- or polyhydric alcohol contains from 2 to 5 hydroxyl groups, said alcohol having a maximum of one hydroxyl group per carbon atom.

7. The fuel oil of claim 1, wherein the mixture of said unsaturated fatty acids comprises dicarboxylic acids.

8. The fuel oil of claim 1, further comprising an alkylphenol-formaldehyde resin present in an additive:resin ratio of from 1:10 to 20:1 by weight.

9. The fuel oil of claim 1, further comprising a copolymer or terpolymer selected from the group consisting of a copolymer containing from 10 to 40% by weight of vinyl acetate and from 60 to 90% by weight of ethylene, an ethylene/vinyl acetate/vinyl neononanoate terpolymer or an ethylene/vinyl acetate/vinyl neodecanoate terpolymer which, apart from ethylene, said terpolymer contains from 10 to 35% by weight of vinyl acetate and from 1 to 25% by weight of said neo compound, a copolymer which, in addition to ethylene and from 10 to 35% by weight of vinyl esters, also contains from 0.5 to 20% by weight of olefin, and mixtures thereof present in a mixing ratio of additive to the above-described copolymer or terpolymer (in parts by weight) of from 20:1 to 1:20.

10. The fuel oil of claim 1, further comprising oil-soluble polar compounds having ionic or polar groups which are obtained by reacting aliphatic or aromatic amines with an aliphatic or aromatic carboxylic acid or anhydride selected from the group consisting of mono-, di-, tri-, tetra and mixtures thereof.

11. The fuel oil of claim 1, further comprising comb polymers of the formula

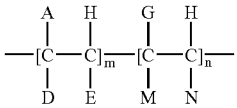

where

A is R', COOR', OCOR', R"-COOR' or OR';

D is H, $CH_3$, A or R;

E is H or A;

G is H, R", R"-COOR', an aryl radical or a heterocyclic radical;

M is H, COOR", OCOR", OR"or COOH;

N is H, R", COOR", OCOR, COOK or an aryl radical;

R' is a hydrocarbon chain having from 8-150 carbon atoms;

R" is a hydrocarbon chain having from 1 to 10 carbon atoms;

m is a number between 0.4 and 1.0; and n is a number between 0 and 0.6 wherein said comb polymers are present in a mixing ratio (in parts by weight) of additives to comb polymers of from 1:10 to 20:1.

12. The fuel oil of claim 1, further comprising copolymers of maleic anhydride and α, β-unsaturated compounds which may optionally be reacted with primary monoalkylamines and/or aliphatic alcohols are additionally present.

13. The fuel oil of claim 1, further comprising reaction products of alkenyl-spiro-bislactones with amines.

14. The fuel oil of claim 1, wherein reaction products of terpolymers based on α, β-unsaturated dicarboxylic anhydrides α, β-unsaturated compounds and polyoxyalkylene ethers of lower unsaturated alcohols are additionally present.

15. A process for improving the lubricity of fuel oils having a sulfur content of at most 0.035% by weight, said process comprising adding to said fuel oil an additive comprising at least one ester of a di- or polyhydric alcohol and a mixture comprising unsaturated fatty acids having carbon chain lengths between 8 and 30 carbon atoms, said unsaturated fatty acids selected from the group consisting of oleic acid, erucic acid, palmitoleic acid, myristoleic acid, linoleic acid, linolenic acid, elaeosteric acid, arachidonic acid, ricinoleic acid, and mixtures thereof, the said ester having an OH number of between 110 and 195 mg KOH/g of ester and an iodine number of more than 100 g of I/100 g of ester, in amounts of from 0.00 1 to 0.5% by weight based on the fuel oil.

16. The fuel oil of claim 1, wherein the mixture comprising unsaturated fatty acids is selected from the group consisting of peanut oil fatty acid, fish oil fatty acid, linseed oil fatty acid, palm oil fatty acid, rapeseed oil fatty acid, ricenic oil fatty acid, castor oil fatty acid, colza oil fatty acid, soya oil fatty acid, sunflower oil fatty acid, tall oil fatty acid, and mixtures thereof.

* * * * *